United States Patent [19]

Focke

[11] 4,057,950

[45] Nov. 15, 1977

[54] CARDBOARD CONTAINER FOR BOTTLES AND THE LIKE

[76] Inventor: Heinz Focke, 309 Verden Moorstrasse, Germany

[21] Appl. No.: 633,136

[22] Filed: Nov. 18, 1975

Related U.S. Application Data

[62] Division of Ser. No. 390,263, Aug. 21, 1973, Pat. No. 3,937,391.

[30] Foreign Application Priority Data

Oct. 23, 1969 Germany ..... 1953350

[51] Int. Cl.[2] ..... B65B 21/06

[52] U.S. Cl. ..... 53/26; 53/32

[58] Field of Search ..... 53/26, 32, 48, 157, 53/158, 159; 206/183, 184, 187; 229/28 R, 29 D

[56] References Cited

U.S. PATENT DOCUMENTS

| | | | |
|---|---|---|---|
| 1,890,965 | 12/1932 | Boeye | 229/28 R X |
| 2,701,938 | 2/1955 | Murray | 53/26 |
| 2,712,882 | 7/1955 | Buttery | 206/183 X |
| 2,933,867 | 4/1960 | Gentry | 53/26 X |
| 3,107,465 | 10/1963 | Cote | 53/48 X |
| 3,166,879 | 1/1965 | Chidsey, Jr. | 53/48 |
| 3,184,143 | 5/1965 | Kotowick | 229/28 R |
| 3,311,284 | 3/1967 | Blais | 229/28 R |
| 3,350,836 | 11/1967 | Dillon et al. | 53/157 X |
| 3,519,127 | 7/1970 | Wood | 53/26 X |
| 3,724,714 | 4/1973 | Wright | 206/187 |
| 3,834,608 | 9/1974 | Giebel | 229/28 R |

*Primary Examiner*—Othell M. Simpson
*Assistant Examiner*—John Sipos
*Attorney, Agent, or Firm*—Sughrue, Rothwell, Mion, Zinn and Macpeak

[57] ABSTRACT

A package or container is provided having interior longitudinal and traverse partitions, or webs, arranged between bottles. The longitudinal web is centrally disposed and is formed by a centrally divided bottom wall being provided with edge flaps which are folded inwardly into the package in such a manner that a double-walled web, disposed approximately at right angles to said bottom wall, is formed. This central longitudinal web is provided with an appropriate number of transverse webs which are either formed separately from the central longitudinal web, or which are formed integrally with the latter by stamping out appropriate tongues and folding them from the web. Integral handles of one-piece construction with the container forming blank are also provided.

1 Claim, 16 Drawing Figures

11a
11'
12
16
14'
14
16'
13
11'
11b
17b
17a
11'
15
14'
15
11'

18
19

14
16
13
12
14'
17a
18
17b
11
15
15
11'
11a
17
11b 14
16
13
12
18
11
10
11a
10
17
11b

Fig. 12
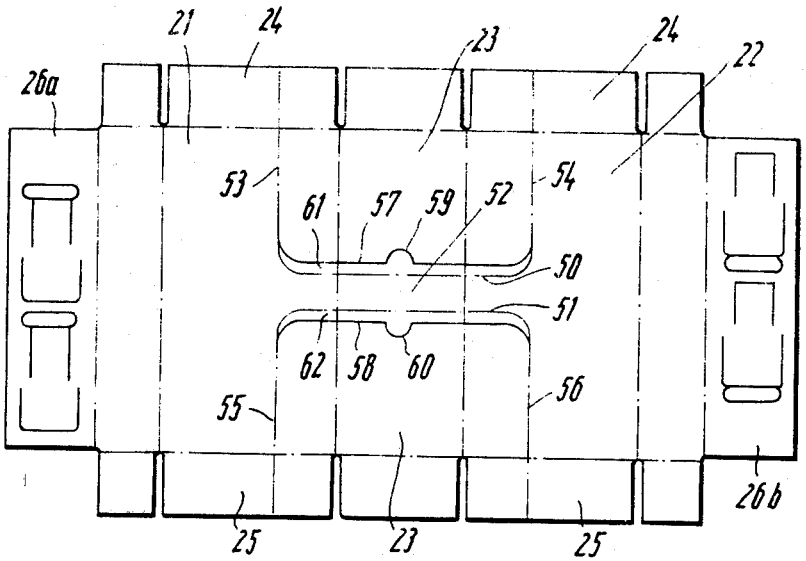
Fig. 13
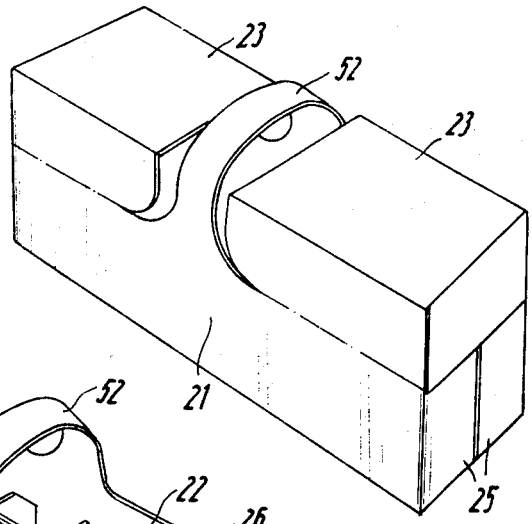
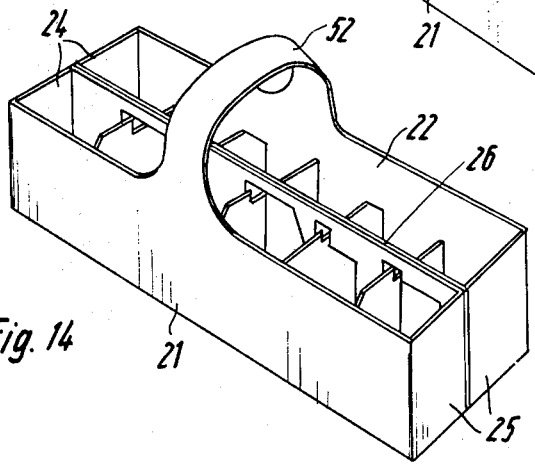
Fig. 14

CARDBOARD CONTAINER FOR BOTTLES AND THE LIKE

This is a division of application Ser. No. 390,263, filed Aug. 21, 1973, now U.S. Pat. No. 3,937,391.

The invention relates to packages or containers formed from foldable material, such as cardboard or corrugated carboard, for example, for the accommodation of segregated articles such as, for example, bottles, cans, and the like, the articles being separated from one another by longitudinal and transverse partitions.

Packages formed of folded cardboard or corrugated cardboard for the accommodation of, for example, bottles or cans, and having partitions or webs arranged between adjacent bottles or cans, are available in a wide variety of designs. The invention proposes a novel package of this kind which can be produced from a blank with very simple folds, and which can be folded and filled mechanically at high speed.

According to the invention, a container formed of foldable material and adapted to hold a plurality of segregated articles, is characterized by a wall structure which includes integral top, side, bottom and end walls, said bottom wall being formed of two portions of said blank extending along opposite sides thereof; a flap coextensive in length with each bottom wall portion along an edge thereof on each of two opposite sides of the blank, the blank being folded into a hollow rectilinear form with the flaps extending into the container perpendicularly to the bottom wall substantially midway between the side walls so as to define a longitudinal partition, and transverse partition means extending transversely within said hollow rectilinear form.

The package according to the invention is remarkable for its simple construction and for the ease with which it may be filled. Another advantage is that the package may conform particularly closely to the contents, which in the above examples are bottles. Thus, the bottles may be packed in a continuous operation, i.e. the bottles may continue to move while they are being packed, thus providing true continuity in the package filling operation.

The present invention further provides a package formed from a particular configuration of blank, and which facilitates the conversion of the finished closed package into a partly or wholly open package having at least one transverse carrying handle. The handle is based on a package of a specific design having a bottom, lateral walls facing each other, and a top, all of these members being connected together and thus forming an originally closed package cross section.

In order to achieve this purpose, one type of package is characterized in that at least two transverse perforations, spaced from each other and running transversely across the package, are arranged in the cover, the perforations passing over, at the edge of the cover, into perforations running approximately in the longitudinal direction of the package and extending over at least a part of the length of the package, each towards one end thereof, in such a manner that the perforation lines define, in the cover, a transverse carrying handle which passes over into the lateral walls.

A package of this kind is particularly suitable for the accommodation of a large number of separate objects, for instance beverage bottles, cans, or the like. The lines of the transverse and longitudinal perforations define areas in the cover, and if necessary in the lateral walls, which facilitate the subsequent removal of parts of the cover and lateral walls, thus producing a carton which is open at the top and has a transverse carrying handle. The pattern of the perforation lines should preferably be such that the transverse perforations extend into the vicinity of the lateral walls and the longitudinal perforations run into them.

Yet another type of package includes the feature that the carrying handle is integral with an inner longitudinal partition. If desired, the wall structure of this package or container may be provided with weakened lines of separation defining an access panel.

Additional details of the invention are described hereinafter with reference to the embodiments illustrated in the accompanying drawings, wherein:

FIG. 12 shows a package blank according to the invention opened out flat;

FIG. 13 shows the closed package with the carrying handle exposed;

FIG. 14 shows the package in the open condition, with the carrying handle;

Figure 1:
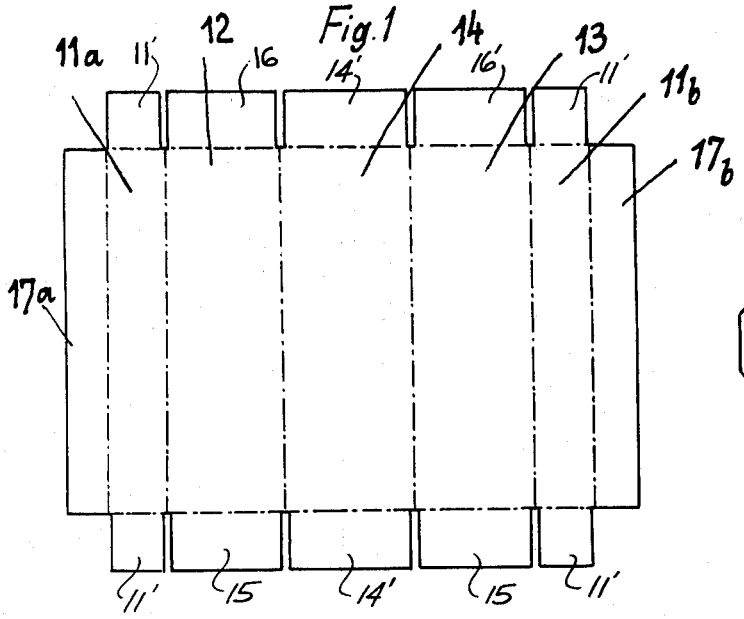
FIG. 1 shows a flat blank from which a package according to one embodiment of the invention is produced.
Figure 2:
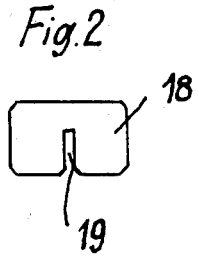
FIG. 2 shows a transverse web for a package according to said one embodiment of the invention.

Referring to the drawings, and in particular to FIGS. 1–4, one type of hollow rectilinear package or container for holding a plurality of segregated articles is formed from a unitary blank which is cut and scored to provide a plurality of interconnected panels certain of which, upon folding of the blank, are adapted to form a wall structure including integral top, side, bottom and end walls.

The top is formed by panel 14, the side walls by panels 12, 13 and the end walls by end tabs 11', 14', and 15 or 16 as the case may be. The bottom is formed by a selected pair of panels **11*a* and 11*b*** which extend along opposite sides of the blank.

Figure 3:
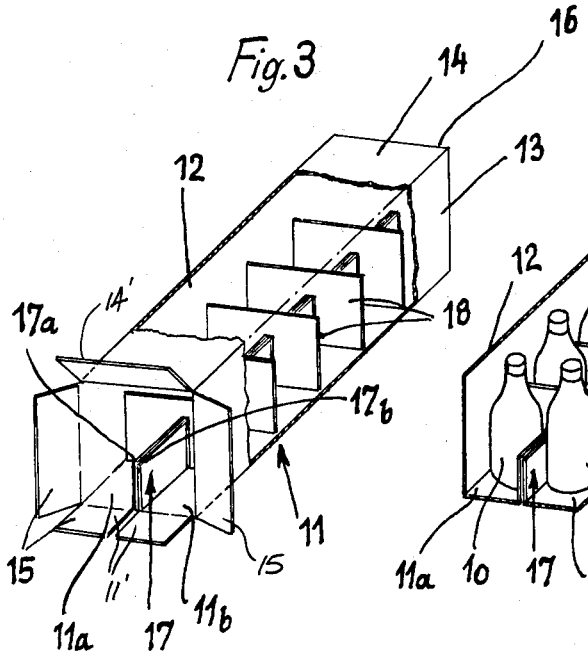
FIG. 3 is a part-sectional perspective view showing an empty, folded package according to said one embodiment of the invention.
Figure 4:
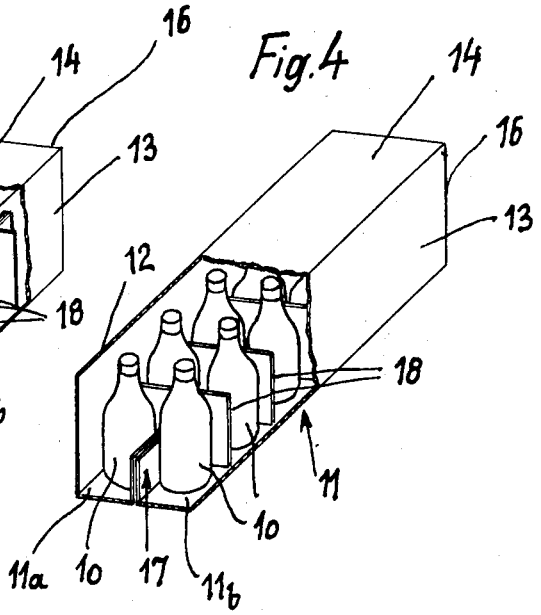
FIG. 4 is a similar perspective view of the package shown in FIG. 3 but in a filled condition.

A further pair of panels **17*a* and 17*b*, opposing faces of which are coated with adhesive, each form a flap coextensive in length with an associated bottom wall panel 11***a*, 11*b* along an edge thereof on opposite sides of the blank. When the blank is folded to form the container, the flaps 17*a*, 17*b* extend into the container (See FIGS. 3 and 4) perpendicular to the bottom wall substantially midway between the side walls 12, 13 where they adhere together so as to define a longitudinal partition dividing the interior of the container into a pair of adjacent and longitudinally extending compartments. The container is sub-divided into a plurality of article receiving compartments through the intermediary of a plurality of discrete transverse webs or partitions 18 of the type shown in FIG. 2, each being provided with a centrally located slot 19 adapted to fit over the longitudinal partition (See FIG. 4). Thus, the articles, or bottles 10 in the case of the embodiment of FIG. 4, are segregated from one another.

The package or container is filled by folding the blank around a double row of bottles 10 which preferably converge towards one another adjacent their upper ends and diverge away from one another adjacent their lower ends. This arrangement makes it possible to fold the flaps 17*a*, 17*b* between the rows of bottles before the two halves of the package and the two rows of bottles are swung together to bring about adhesion between said flaps. The transverse partitions 18 which have previously been positioned between the bottles but above the longitudinal partition, are then lowered on to the latter to take up their final position which is shown in FIGS. 3 and 4.

Figure 5:
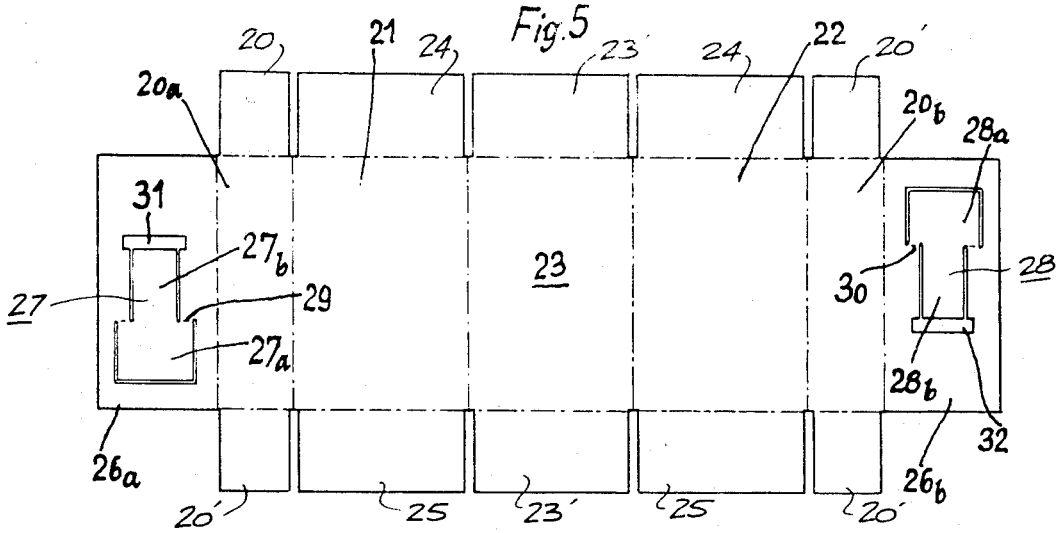
FIG. 5 shows another blank from which a package according to a second embodiment of the invention is produced.
Figure 6:
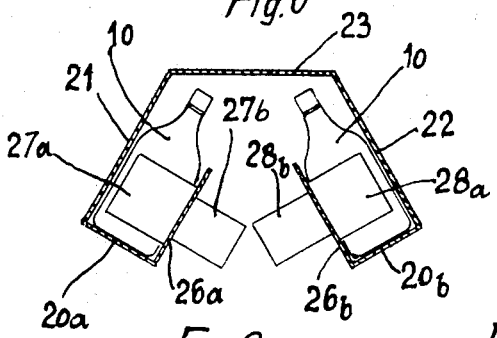
FIG. 6 shows one phase in the operation of folding and filling the second type of package.
Figure 7:
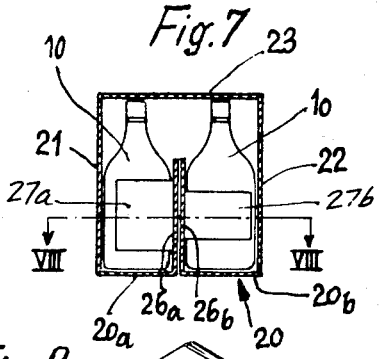
FIG. 7 is a cross section of the folded and filled second type of package.
Figure 8:
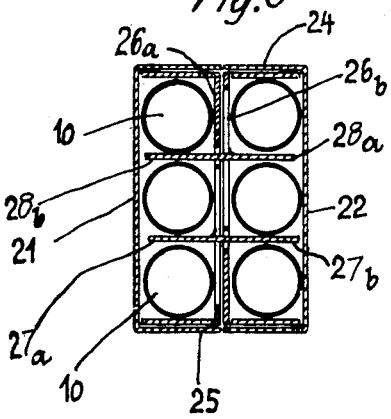
FIG. 8 is a horizontal section on the line VIII—VIII FIG. 7.
Figure 9:
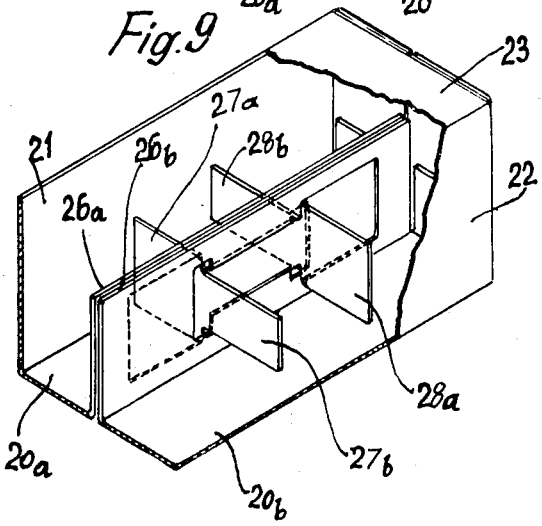
FIG. 9 is a part sectional perspective view of the second type of package shown in an empty condition.

An alternative embodiment of the invention can be formed from the type of one-piece blank shown in FIG. 5. The top of the container ultimately formed from this blank is constituted by panel 23, the side walls by panels 21, 22 and the end walls by end tabs 20', 23' and 24 or 25 as the case may be. The bottom is formed by the pair of panels 20*a*, 20*b* and the longitudinal partition by adhesively coated panels 26*a*, 26*b*. In this arrangement, however, the configuration and arrangement of the transverse partitions is different from that of the first embodiment.

If reference is now made to FIG. 5, it will be seen that each flap panel 26*a*, 26*b* is scored and incised to provide at least one portion, indicated generally at 27, 28, which is hingeable on score lines 29, 30 whereby it is capable of being swung out of the plane of its associated panel to extend normal thereto so as to form oppositely projecting tabs 27*a*, 27*b*, 28*a* and 28*b*, said tabs 27*a* and 28*a* having a greater depth than the tabs 27*b* and 28*b*. It will also be observed from FIG. 5 that each flap panel 26*a*, 26*b* is provided with a slit 31, 32 so that when the hingeable portions 27, 28 are pivoted on score lines 29, 30, tab 27*b* for example will project through slit 32 of portion 28 while tab 28*b* will project through slit 31 whereby all of the tabs will serve as transverse partitions.

The package or container shown in FIGS. 5–9 is also filled in a manner similar to that described above in connection with the first embodiment i.e. by folding the blank about a pair of inclined rows of bottles 10. As this occurs, the transverse partitions will pivot normal to the flap panels 26*a*, 26*b* whereby the narrower tabs 27*b*, 28*b* will enter their associated slots. Mechanical filling may again be carried out effectively at high speed.

Figure 10:
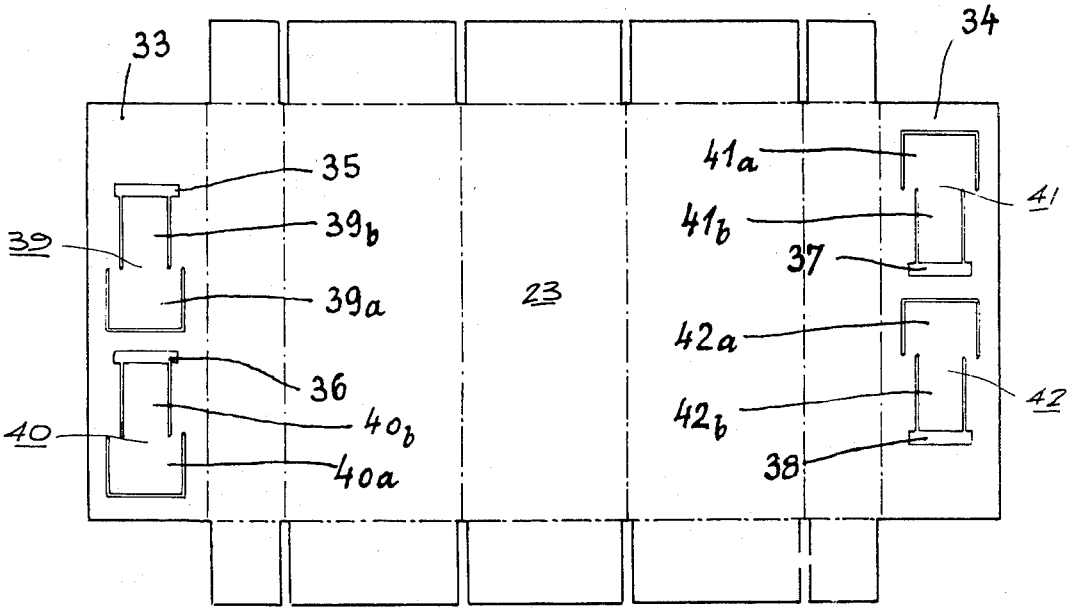
FIG. 10 shows yet another blank from which a third type of package is produced.

FIG. 10 shows a further type of one-piece blank capable of forming a package or container rather similar to that shown in FIG. 5 with the exception that each flap panel 33, 34 is scored and incised to provide a pair of portions 39, 40 and 41, 42 respectively as well as slits 35, 36 and 37, 38 respectively. Hence, swingable tabs 39*a* – 42*b* are provided and which tabs serve, when extending normal to the longitudinal partitions and when selected ones of their number engage with the slits, as a plurality of transverse partitions.

Obviously each flap panel can be scored and incised to provide any required number of tabs depending upon the number of article receiving compartments desired.

Figure 11:
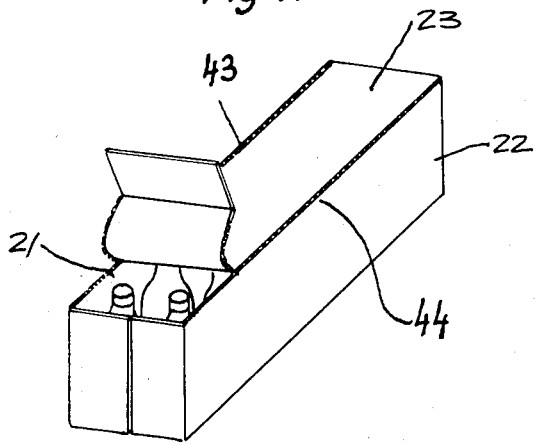
FIG. 11 is a perspective view of a filled package according to the invention, which incorporates an additional characteristic.

FIG. 11 shows that it is within the ambit of the invention to provide the package or container with weakened lines of separation in its wall structure so that selected portions of the latter can be removed so as to obtain access to the contents of the container. In the example shown in FIG. 11, the top 23 can be removed along the lines of separation 43, 44.

Although the articles have been described and illustrated as being bottles 10, it will be readily apparent that the invention is eminently suitable for the packaging of other generally elongated objects such as, for example, cans or the like.

To facilitate the present description of the embodiment of FIGS. 12-14, reference should also be made to FIG. 10.

The package blank is provided with perforation lines, namely two transverse perforations 50, 51 spaced from each other and running substantially transversely of the cover 23. These transverse perforations 50, 51 which define a transverse carrying handle 52, extend as far as lateral walls 21, 22 where they pass, running in arcs, into longitudinal perforations 53, 54 and 55, 56. Longitudinal perforations 53...56 run from the ends of transverse perforations 50, 51 to the end of the package and to the flaps forming end-walls 24, 25.

The example of embodiment illustrated contains a parting cut 57, 58 parallel to transverse perforations 50, 51 and outside the area of carrying handle 52. This parting cut is arranged in such a manner as to produce an engagement tab 59, 60 in the central portion of cover 23. The ends of parting cuts 57, 58 pass over, in the form of arcs, into longitudinal perforations 53...56.

A finished package, folded from a blank of this kind may be used by the consumer in various ways. In FIG. 13, only strips of material 61, 62 formed on each side of carrying handle 52 and defined by transverse perforation 50, 51 and parting cuts 57, 58 have been released from the walls of the package. This produces gaps of a width suitable to enable the carrying handle 52 to be grasped while the remainder of the carton stays closed.

In the design illustrated in FIG. 14, the whole of the cover 23, parts of the lateral wall, 21, 22 and of the endwalls 24, 25 have been removed with the aid of longitudinal perforations 53 . . . 56, producing a container of reduced height, open at the top, and having a transverse carrying handle.

This container may now be used as a carrying basket, from which the contents may easily be removed.

Figure 16:
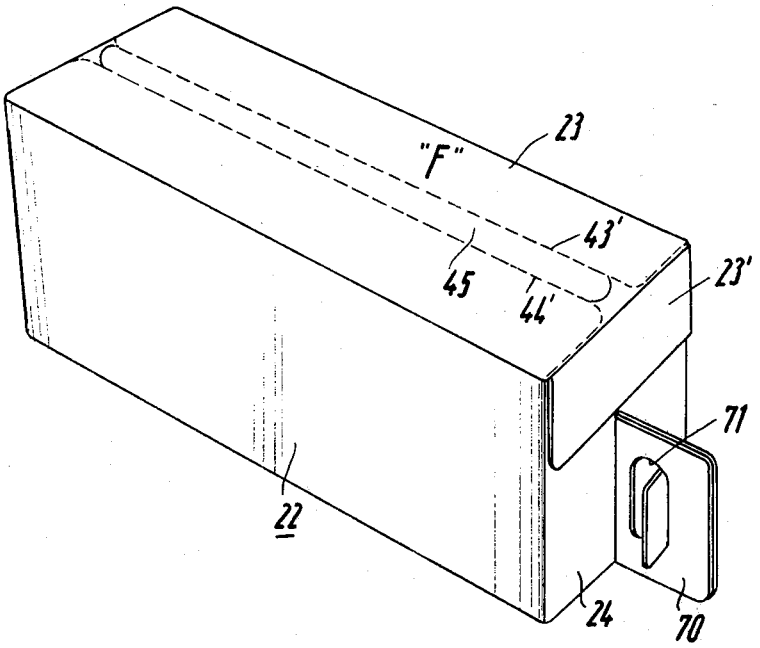
FIG. 16 is a perspective view of the closed container formed by the blank of FIG. 15.
Figure 15:
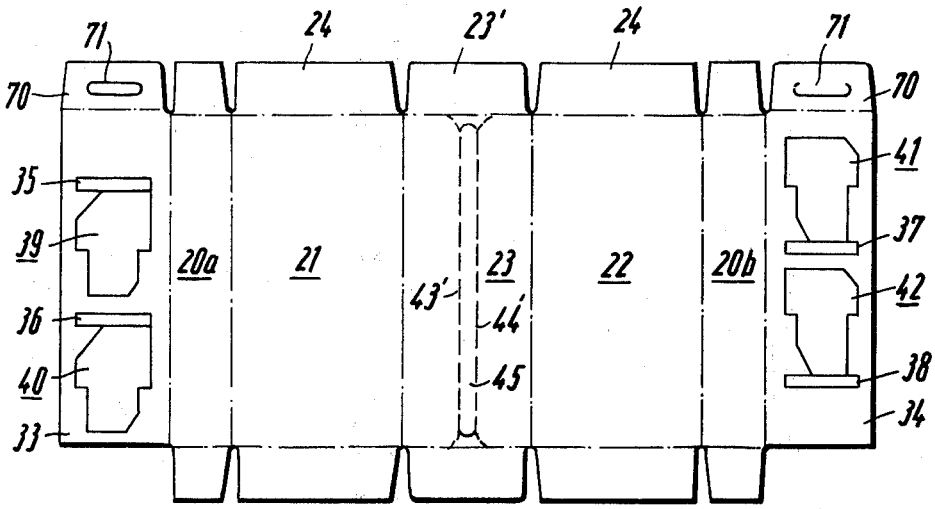
FIG. 15 shows yet a further one-piece bland adapted to for a package or container having carrying means.

FIG. 15 employs many of the same references that are used in FIG. 10 for like parts and inasmuch as the formation of the mutually transverse partitions and the formation of the package and its method of filling is substantially the same as that described above, no further description of the main characteristics of the blank in FIG. 15 is considered necessary. However, the blank of FIG. 15 differs from that shown in FIG. 10 in that a selected end of each flap panel 33, 34 is provided with an integral end tab 70 and which tab may or may not be hingeable with respect to the remainder of its said flap panel. Each tab 70 is provided with a suitably shaped hand-hold 71. Thus, and as will be seen from FIG. 16, the package formed by the one-piece blank of FIG. 15 will be provided with an integral carrying handle which, in the form of package illustrated, projects from a selected end wall.

Additionally, the blank of FIG. 15 differs from that shown in FIG. 10 in that the top 23 is provided with a pair of weakened lines of separation 43', 44' which define a tearstrip or panel 45 whereby access can be obtained to the contents of the package.

What is claimed is:

1. A process for inserting a double row of articles such as bottles, cans or the like into a container and preparing said container from a unitary blank having integral top, side, bottom and end walls, wherein said bottom wall is formed of two portions of the blank on opposite sides thereof with a flap co-extensive in length with each bottom portion and from at least one cross-piece provided with a slit which is adapted to be placed in a form locking manner on a central longitudinal piece formed from said flaps, comprising positioning said rows of articles with each row disposed upright in oppositely slanting positions adjacent each other at the top, placing said cross-piece between adjacent articles in the row adjacent the tops of the articles, folding the unitary blank about the two rows of articles while the articles are disposed in the oppositely slanted position, and extending the flaps upwardly between said rows, bringing the separated rows of articles together and lowering the cross-pieces over the longitudinal central piece defined by said flaps.

* * * * *